US006967593B2

(12) United States Patent
Carroll

(10) Patent No.: US 6,967,593 B2
(45) Date of Patent: Nov. 22, 2005

(54) EMERGENCY VEHICLE APPROACH WARNING METHOD AND SYSTEM

(75) Inventor: Dennis J. Carroll, Houston, TX (US)

(73) Assignee: International Business Machines Corporation, Armonk, NY (US)

( * ) Notice: Subject to any disclaimer, the term of this patent is extended or adjusted under 35 U.S.C. 154(b) by 92 days.

(21) Appl. No.: 10/607,409

(22) Filed: Jun. 26, 2003

(65) Prior Publication Data

US 2004/0263355 A1 Dec. 30, 2004

(51) Int. Cl.[7] ..... G08G 1/095

(52) U.S. Cl. ..... 340/907; 340/555; 340/556; 340/557; 340/902; 250/334; 353/13; 33/264

(58) Field of Search ..... 340/907, 555, 340/556, 557, 435, 436, 901, 902, 903, 904; 250/214 R, 214 W, 221, 330, 334, 551; 353/13; 33/264, 286; 116/28 R; 307/10.1

(56) References Cited

U.S. PATENT DOCUMENTS

| | | | | | |
|---|---|---|---|---|---|
| 4,017,825 | A | | 4/1977 | Pichey | |
| 4,704,610 | A | | 11/1987 | Smith et al. | |
| 4,736,186 | A | | 4/1988 | Jones | |
| 4,775,865 | A | | 10/1988 | Smith et al. | |
| 5,620,155 | A | * | 4/1997 | Michalek | 246/121 |
| 5,677,684 | A | | 10/1997 | McArthur | |
| 5,734,339 | A | | 3/1998 | Ogle | |
| 5,757,284 | A | | 5/1998 | Trizzino et al. | |
| 6,005,491 | A | | 12/1999 | Kopchak et al. | |
| 6,087,961 | A | | 7/2000 | Markow | |
| 6,198,386 | B1 | * | 3/2001 | White, II | 340/435 |
| 6,215,200 | B1 | * | 4/2001 | Genzel | 307/10.1 |
| 6,281,806 | B1 | * | 8/2001 | Smith et al. | 340/901 |
| 6,317,058 | B1 | * | 11/2001 | Lemelson et al. | 340/910 |
| 6,448,904 | B1 | | 9/2002 | Flores | |
| 6,590,495 | B1 | * | 7/2003 | Behbehani | 340/435 |
| 6,733,134 | B2 | * | 5/2004 | Bleiner | 340/904 |

* cited by examiner

*Primary Examiner*—Davettea W. Goins
(74) *Attorney, Agent, or Firm*—William E. Schiesser; Hoffman, Warnick & D'Alessandro LLC

(57) ABSTRACT

Under the present invention, a warning unit having a light source (e.g., a laser) is mounted on an emergency vehicle. The light source first emits a low intensity light beam (e.g., an infrared light beam) to scan an area in front of the emergency vehicle. The scan is used to detect one or more objects having a height to width ratio exceeding a predetermined threshold. Specifically, the scan is used to detect one or more tall, narrow objects such as poles, sign posts, etc., while ignoring other objects such as people, animals, etc. Once any applicable objects are detected, a second, higher intensity light beam is emitted to illuminate the detected objects with a predetermined indicia. The predetermined indicia can be observed by other motorists and indicates to them a direction of origin of the emergency vehicle.

30 Claims, 7 Drawing Sheets

EMERGENCY VEHICLE APPROACH WARNING METHOD AND SYSTEM

FIELD OF THE INVENTION

In general, the present invention provides an emergency vehicle approach warning method and system. Specifically, under the present invention, light imaging technology is utilized to detect and illuminate certain objects along a roadway to warn motorists of an approaching emergency vehicle.

BACKGROUND OF THE INVENTION

As the number of vehicles on the road increases, roadway traffic is becoming a growing concern. This is especially the case in urban areas where the quantity of vehicles on the road often approaches or exceeds capacity. One particular area of concern involves emergency vehicles. Specifically, when responding to an emergency, an emergency vehicle must often traverse the streets in a potentially dangerous manner. This could involve exceeding local speed limits, passing other vehicles, and crossing intersections against the traffic signals. Although this could be necessary to properly respond to the emergency, it could create hazardous conditions for other motorists.

Part of the overall problem is the inability of the other motorists to accurately detect the direction from which an emergency vehicle is coming. For example, although a motorist might hear sirens, he/she might not be able to determine the direction from which the sound is coming. This is especially the case around an intersection where an emergency vehicle could approach from any number of directions. Sirens can also be inadequate because they are often not heard until the emergency vehicle is imminent. In addition, a siren may not even be heard by another motorist due to various distractions within his/her vehicles (e.g., a radio being played too loudly). As such, many sirens fail to provide ample warning time.

Heretofore, various systems have been developed for attempting to warn motorists of approaching emergency vehicles. For example, one system changes a traffic signal to be favorable to an approaching emergency vehicle. Unfortunately, this system not only requires a transmitter to be positioned on the emergency vehicles, but receivers to be positioned on each traffic signal as well. As such, the implementation and maintenance of such a system can be extremely costly. Moreover, such a system gives no indication that an emergency exists, rather, it merely changes the traffic signal. Accordingly, another motorist might not realize that an emergency vehicle is approaching and he/she might not stay clear of the intersection (e.g., he/she might still attempt to make a right turn on red). One other system involves positioning a transmitter on an emergency vehicle, and a specially adapted direction finding antenna on the other vehicles. As the emergency vehicle approaches, a signal is transmitted from the transmitter to the direction finding antenna to warn the motorist of the approaching emergency vehicle. Similar to the previous system, however, this system requires multiple "units." Specifically, a transmitter must be positioned on the emergency vehicle and a receiver (e.g., a specially adapted direction finding antenna) must be positioned on all other vehicles. In addition, with both of these systems, there is often a latency involved in changing the traffic signal, or warning the approaching vehicles. Such a latency could be the cause for accidents and injury.

In view of the foregoing, there exists a need for an emergency vehicle approach warning method and system. Specifically a need exists for motorists to be warned of an approaching emergency vehicle. A further need exists for such a system to not require both transmitters and receivers. Still yet, a need exists for such a system to indicate to the motorists the direction from which the emergency vehicle is approaching (i.e., a direction of origin of the emergency vehicle).

SUMMARY OF THE INVENTION

In general, the present invention provides an emergency vehicle approach warning method and system. Specifically, under the present invention, a warning unit having a light source (e.g., a laser) is mounted on an emergency vehicle. The light source first emits a low intensity light beam (e.g., an infrared light beam) to scan an area in front of the emergency vehicle. The scan is used to detect one or more objects having a height to width ratio exceeding a predetermined threshold. Specifically, the scan is used to detect one or more tall, narrow objects such as poles, sign posts, etc., while ignoring other objects such as people, animals, buildings, etc. Once any applicable objects are detected, a second, higher intensity light beam is emitted to illuminate the detected objects with a predetermined indicia. The predetermined indicia can be observed by other motorists and indicates to them a direction of origin of the emergency vehicle. Typically, the scan, detect and illuminate operations of the present invention are continuously repeated at a frequency above human perception (e.g., at least approximately 12 Hz).

A first aspect of the present invention provides a method for providing an emergency vehicle approach warning, comprising: scanning an area using a first light beam; detecting at least one object in the scanned area having a height to width ratio exceeding a predetermined threshold; and illuminating the at least one object with a predetermined indicia using a second light beam.

A second aspect of the present invention provides a method for providing an emergency vehicle approach warning, comprising: scanning an area in front of an emergency vehicle using a first light beam having a first intensity; detecting at least one object in the scanned area having a height to width ratio exceeding a predetermined threshold; and illuminating the at least one object with a predetermined indicia using a second light beam having a second intensity, wherein the predetermined indicia indicates a direction of origin of the emergency vehicle.

A third aspect of the present invention provides an emergency vehicle approach warning system, comprising a light emitter for emitting a first light beam for scanning an area to detect at least one object having a height to width ratio exceeding a predetermined threshold, wherein the light emitter further emits a second light beam to illuminate the at least one object with a predetermined indicia.

Therefore, the present invention provides an emergency vehicle approach warning method and system.

BRIEF DESCRIPTION OF THE DRAWINGS

These and other features of this invention will be more readily understood from the following detailed description of the various aspects of the invention taken in conjunction with the accompanying drawings in which.

Figure 1:
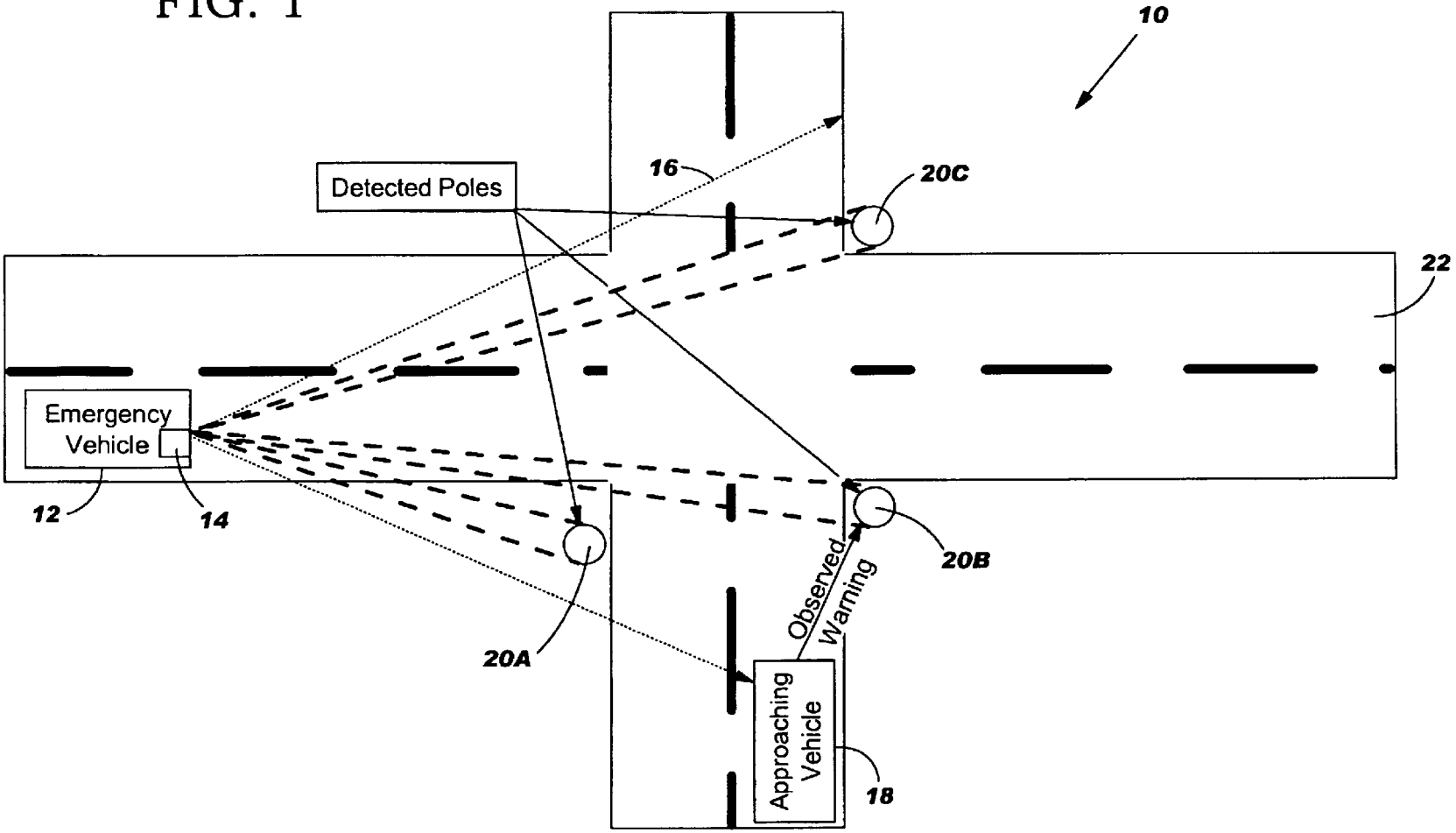
FIG. 1 depicts an emergency vehicle approach warning system according to the present invention.

The drawings are merely schematic representations, not intended to portray specific parameters of the invention. The drawings are intended to depict only typical embodiments of the invention, and therefore should not be considered as limiting the scope of the invention. In the drawings, like numbering represents like elements.

BEST MODE FOR CARRYING OUT THE INVENTION

As indicated above, the present invention provides an emergency vehicle approach warning method and system. Specifically, under the present invention, a warning unit having a light source (e.g., a laser) is mounted on an emergency vehicle. The light source first emits a low intensity light beam (e.g., an infrared light beam) to scan an area in front of the emergency vehicle. The scan is used to detect one or more objects having a height to width ratio exceeding a predetermined threshold. Specifically, the scan is used to detect one or more tall, narrow objects such as poles, sign posts, etc., while ignoring other objects such as people, animals, buildings, etc. Once any applicable objects are detected, a second, higher intensity light beam is emitted to illuminate the detected objects with a predetermined indicia. The predetermined indicia can be observed by other motorists and indicates to them a direction of origin of the emergency vehicle. Typically, the scan, detect and illuminate operations of the present invention are continuously repeated at a frequency above human perception (e.g., at least approximately 12 Hz).

Referring now to FIG. 1, an emergency vehicle approach warning system 10 is shown. Under the present invention emergency vehicle 12 is equipped with warning unit 14. In general, warning unit 14 illuminates certain objects with a predetermined indicia so that motorists in other vehicles (e.g., approaching vehicle 18) are warned that emergency vehicle 12 is approaching. In a typical embodiment, warning unit 14 is integrated with the light system (not shown) that is mounted on the roof of emergency vehicle 12. However, it should be understood that warning unit 14 could be mounted anywhere on or within emergency vehicle 12. As will be further described below, warning unit 14 includes components that allow an area 16 in front of emergency vehicle 12 to be scanned. Based on the scan, at least one object 20A–C whose height to width ratio exceeds a predetermined threshold to be detected. Those objects 20A–C will then be illuminated with a predetermined indicia that indicate a direction of origin of emergency vehicle 12.

Figure 2:
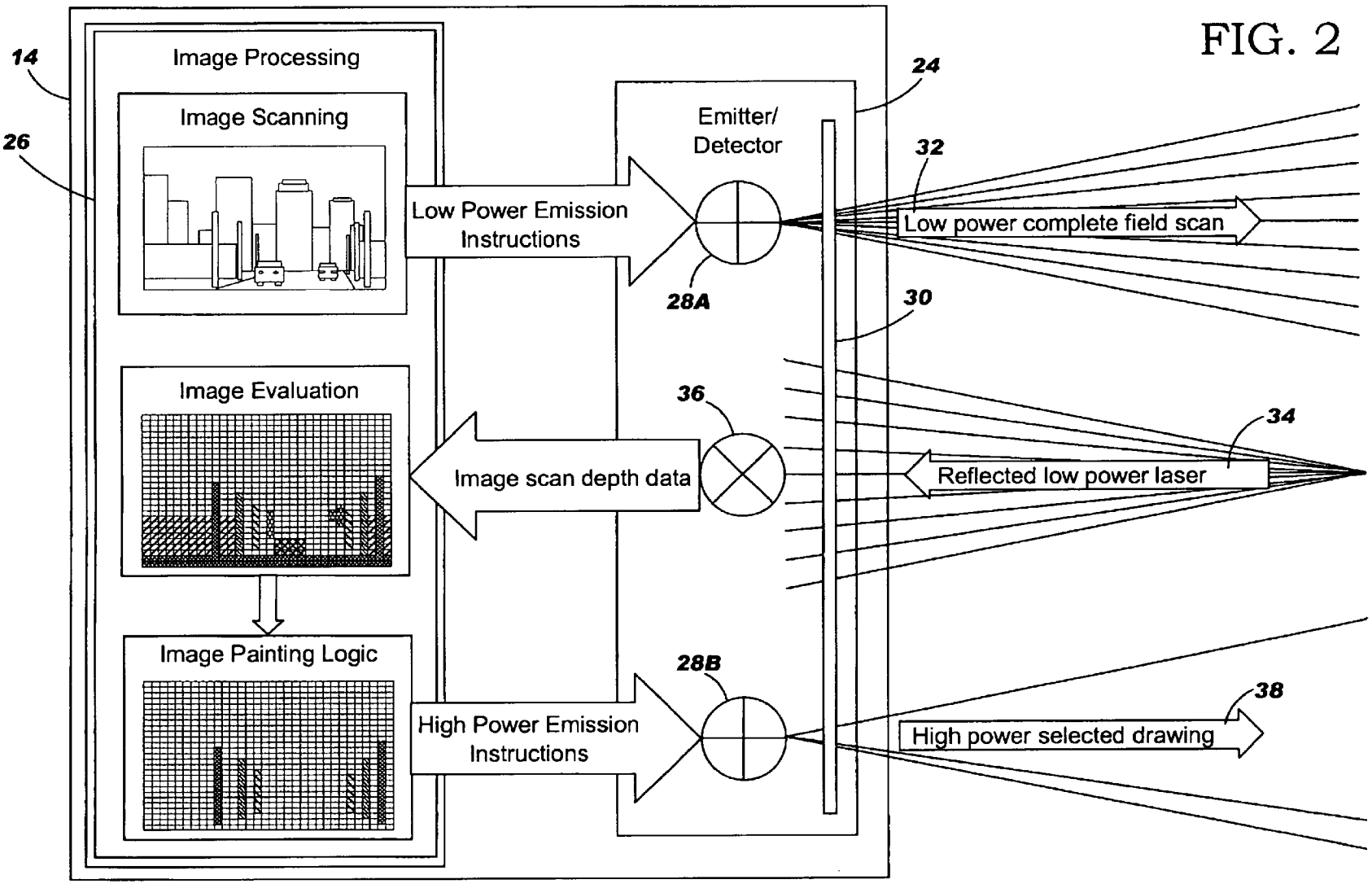
FIG. 2 depicts the warning unit of FIG. 1 in greater detail, according to the present invention.

Referring now to FIGS. 1 and 2 collectively, a more detailed description of warning unit 14 will be given. In general, warning unit 14 includes light emitter/detector 24 and image processing logic 26. Within light emitter/detector 24 is at least one high intensity-capable light source 28A–B (e.g., one or more lasers) that is capable of emitting light beams (e.g., laser beams) at varying frequencies. In a typical embodiment, light source 28A emits a first light beam 32 having a low intensity (e.g., such as infrared light) and which is deflected by electromagnetic deflectors 30. This allows area 16 in front of emergency vehicle 12 to be scanned determine an overall image thereof. Specifically, the first light beam 32 is emitted from warning unit 14 into area 16. After contacting various object within area 16, return (light) beam 34 is communicated (i.e., bounced back) 34 to at least one sensor 36 within warning unit 14. Returned beam 34 provides an image of area 16 that can be processed by image processing logic 26. To this extent, based on the speed (D/T) of the first light beam and amount of time (T) it took to come back, the distance (D) of the objects within area 16 from emergency vehicle 12 can be determined. This provides warning unit 14 with a depth perception of the objects within area 16. In addition, the returned beam 34 is processed by image processing logic 26 within warning unit 14 to determine an approximate height and width of each object contacted. Based on this data, image processing logic 26 will detect at least one object 20A–C whose height to width ratio exceeds a predetermined threshold (i.e., vertically-oriented objects such as poles, sign posts, etc.) Under the present invention, the predetermined threshold should be large enough so that other objects such as people, animals, buildings, cars, etc. will not be detected. Also, because first light beam 32 scans entire area 16 and will presumably contact other objects, the first light beam 32 has a lower intensity so that injuries will not be inflicted on animate objects such as people and animals.

In any event, once one or more objects 20A–C have been detected, image processing logic 26 will cause light source 28B to emit a second light beam 38 that has a higher intensity than first light beam 32. Similar to first light beam 32, the second light beam will be deflected by electromagnetic deflectors 30. However, second light beam 38 will only be directed at detected objects 20A–C and will illuminate objects 20A–C with a predetermined indicia that a warns the motorist in vehicle 18 of the approach of emergency vehicle 12. As will be further shown below, the predetermined indicia typically comprises an "X" with a horizontal line through the center. This is so that it clearly indicates to the motorist within vehicle 18 a direction of origin of emergency vehicle 12. To this extent, second light beam 38 has a higher intensity than the first light beam so that it is visible and can adequately illuminate objects 20A–C. For example, in a typical embodiment, second light beam 38 creates a red-colored indicia on objects 20A–C.

It should be understood that although separate light sources 28A–B have been shown for emitting first light beam 32 and second light beam 38, this need not be the case. Rather, a single light source could be provided within warning unit 14 that is capable of emitting both light beams 32 and 38. In any event, this process of scanning, detecting and illuminating is continuously repeated at a frequency greater than human perception (e.g., at least approximately 12 Hz). This allows vertically-oriented objects to be continuously detected and illuminated as emergency vehicle 12 traverses roadway 22 without the other motorists observing a "flicker" in the indicia.

Figure 3:
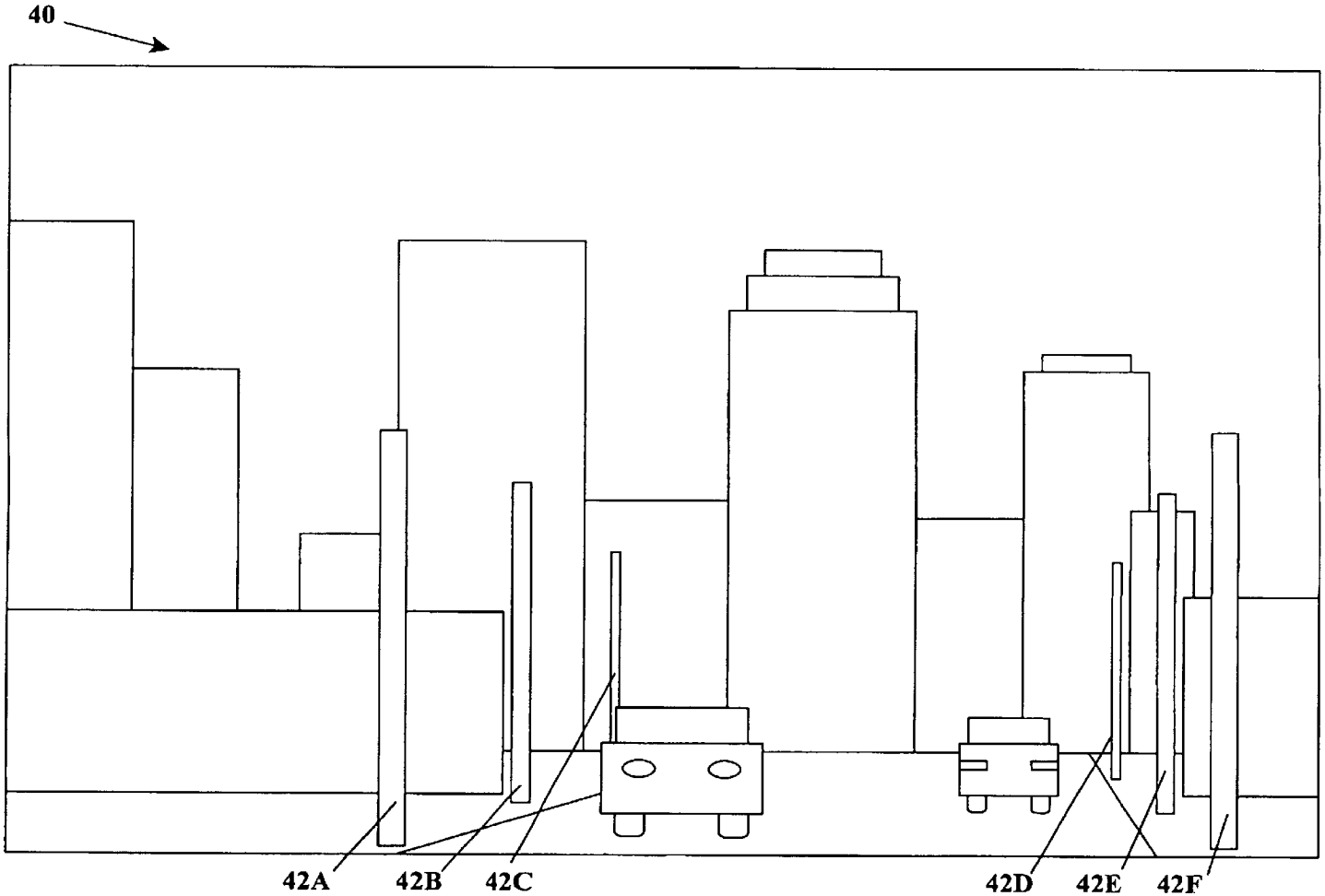
FIG. 3 depicts an illustrative view from an emergency vehicle, according to the present invention.
Figure 4:
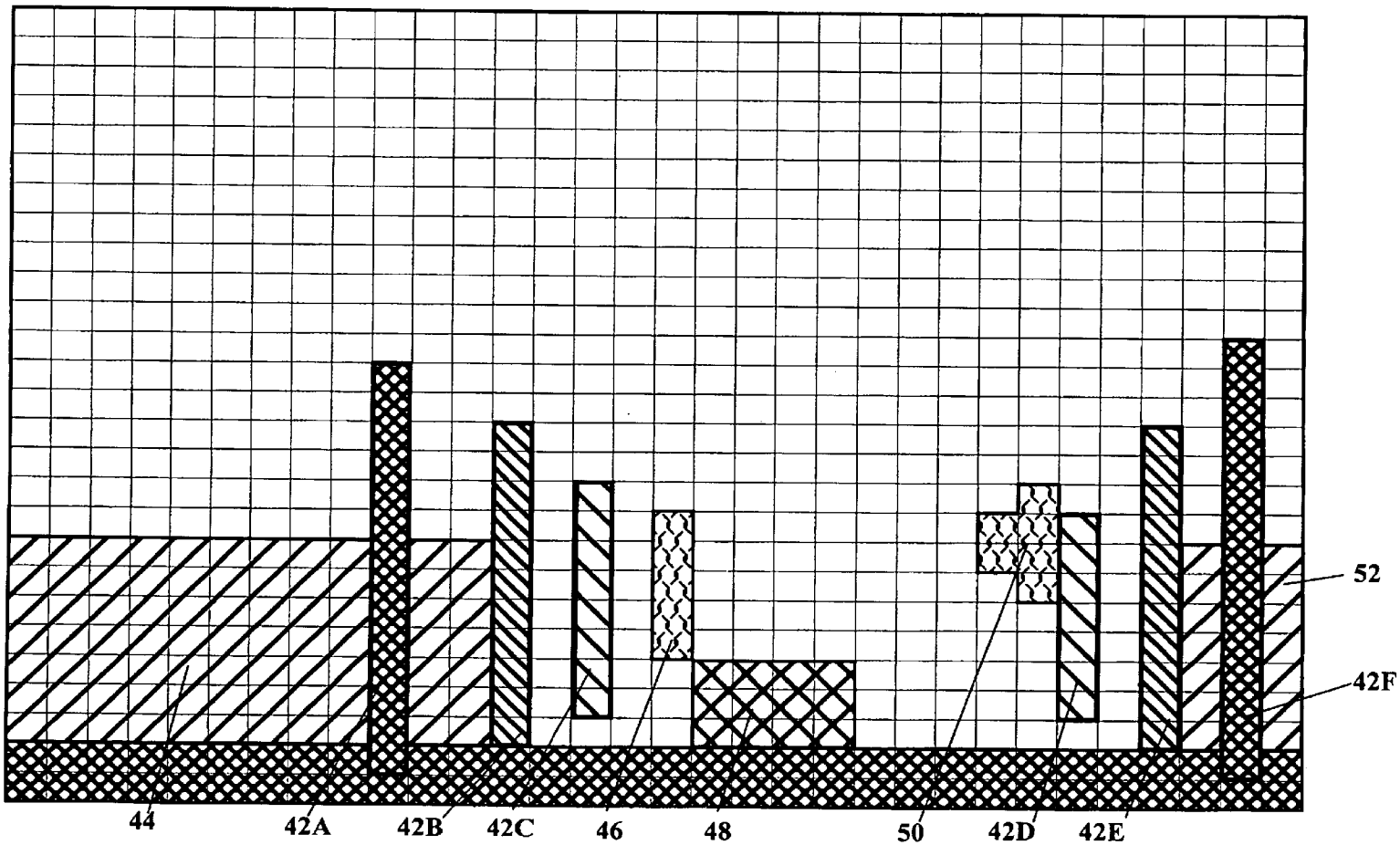
FIG. 4 depicts the view of FIG. 3 as scanned with the warning unit of FIGS. 1 and 2, according to the present invention.

Referring now to FIG. 3, an illustrative view 40 from emergency vehicle 12 (FIG. 1) is shown. As depicted, view 40 includes various vertically-oriented objects 42A–F (e.g., poles). As explained above, light emitter/detector 24 within warning unit 14 will emit a first light beam to scan the area in front of emergency vehicle 12. FIG. 4, depicts the view of FIG. 3 after being scanned by the first light beam. As can be seen several objects have been scanned and represented in a scan-grid 54. Such objects include vertically oriented objects 42A–F, buildings 44 and 52, foliage 46 and 50 and vehicle 48. Based on the scan, the image processing logic within monitoring unit 14 will calculate the height to width ratio for all scanned objects, and then "detect" or identify only those objects whose height to width ratio exceeds the predetermined threshold. As can be seen in FIG. 4, objects 42A–F all have a height that far exceeds their width. For example, in scan-grid 54 of FIG. 4, object 42A has a height of 17 units/block and a width of 1. Thus, the height to width ratio of object 42A is 17:1. Conversely, vehicle 48 has a height of 2 units and a width of 5, for a ratio of 2:5. If the height to width threshold is 5:1, only objects 42A–F will be detected by monitoring unit 14.

Figure 5:
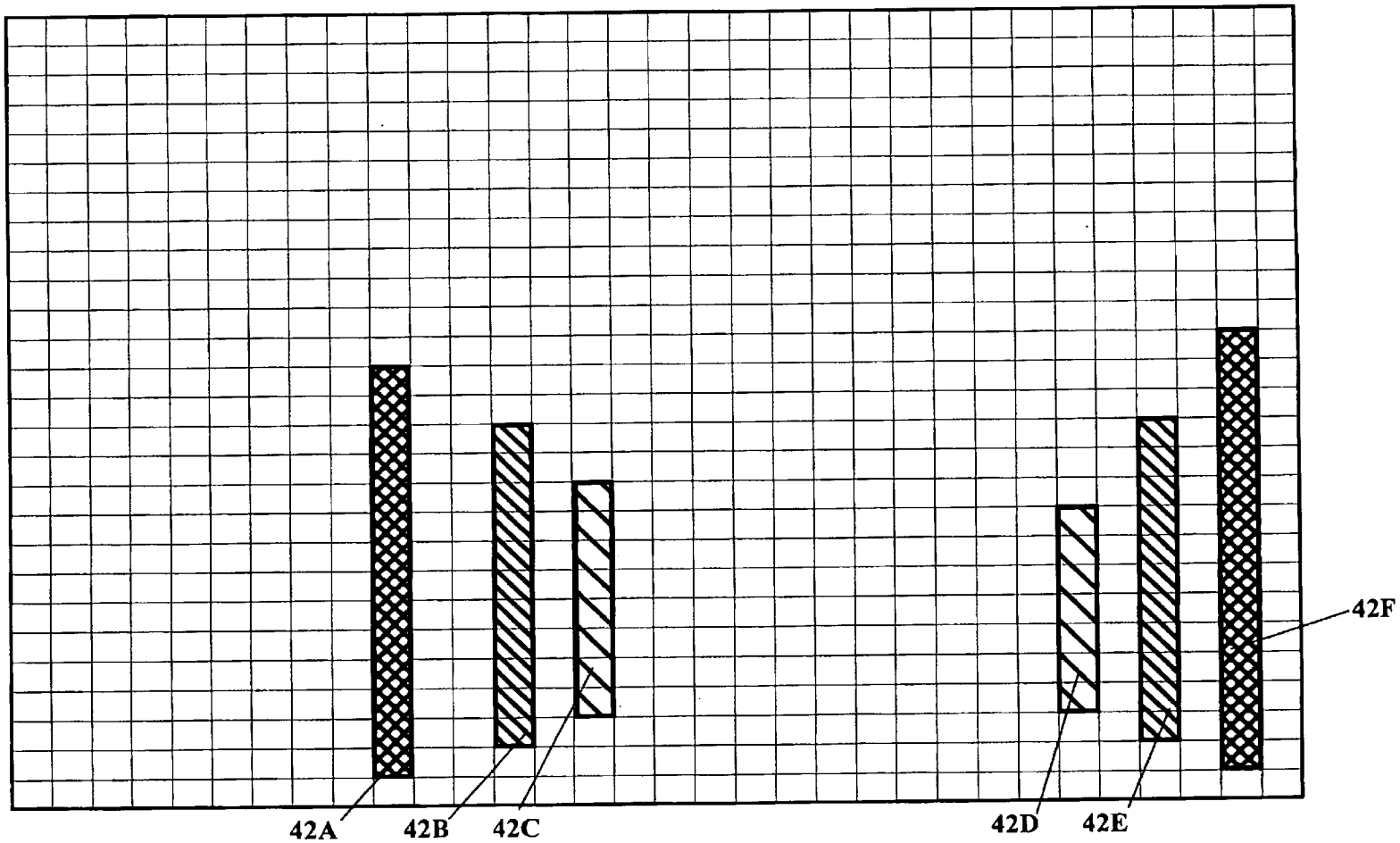
FIG. 5 depicts the scanned view of FIG. 3 after being processed to detect vertically-oriented objects, according to the present invention.

Referring now to FIG. 5, the scanned view of FIG. 4 is shown after being further processed by the image processing logic. Specifically, by applying the predetermined threshold (e.g., 5:1) to the calculated height to width ratios, several objects are filtered out. That is, monitoring unit 14 will only "detect" objects having a height to width ratio exceeding the predetermined threshold and which can therefore be considered "vertically-oriented objects." In this illustrative embodiment, the only "detected" objects are objects 42A–F. From view 40 of FIG. 3, it can be seen that objects 42A–F represent poles along the roadway. Once objects 42A–F are detected, light emitter/detector 24 within warning unit 14 will emit a second, higher intensity light beam that will illuminate objects 42A–F with a predetermined indicia.

Figure 6:
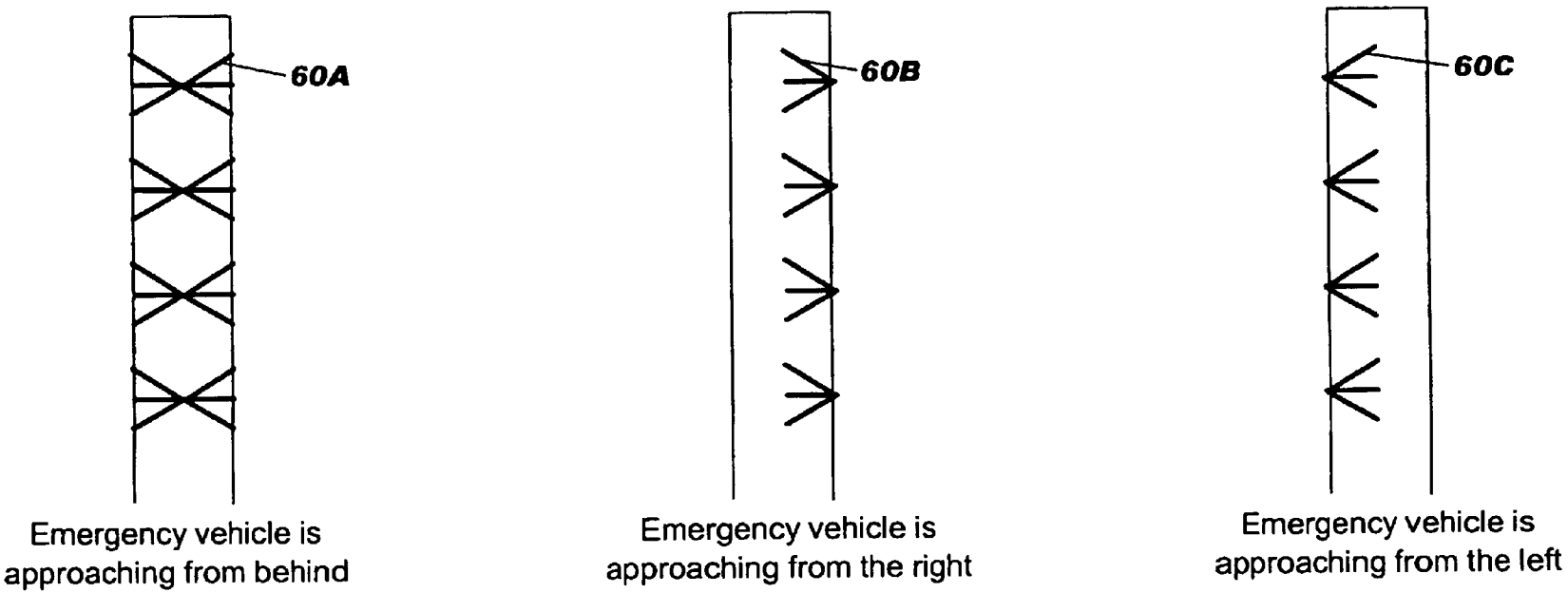
FIG. 6 depicts illustrative indicia with which detected vertically-oriented objects are illuminated, according to the present invention.

Referring to FIG. 6, predetermined indicia 60A is shown in greater detail. In general, predetermined indicia 60A includes a "X" with a horizontal line through the center, which can be illuminated multiple times on each object 42A–F. In addition, because indicia 60A is illuminated on relatively tall and narrow objects, indicia 60A will appear to "wrap around" the sides thereof. This allows indicia 60A to resemble an arrow (e.g., 60B and 60C) that indicates the direction from which emergency vehicle 12 is coming. Accordingly, the indicia 60A–C accommodates the numerous angles that a motorist may view a roadway (e.g., such as at the intersection of FIG. 1). For example, when a motorist sees indicia 60A, he/she knows that emergency vehicle 12 is approaching from behind. Alternatively, when the motorist is traversing a road that intersects the road on which emergency vehicle 12 is traveling, indicia 60B or 60C will be seen, depending on the direction of origin of emergency vehicle 12. Specifically, if the motorist sees indicia 60B, he/she knows that emergency vehicle 12 is approaching from the right. Still yet, when the motorist sees indicia 60C, he she knows that emergency vehicle 12 is approaching from the left. In the event that the motorist is approaching emergency vehicle 12 from an oncoming direction, he/she will not see an indicia, however, emergency vehicle 12 itself will be viewable. Based on this implementation, the motorist within vehicle 18 (FIG. 1) will see indicia 60C.

Figure 7:
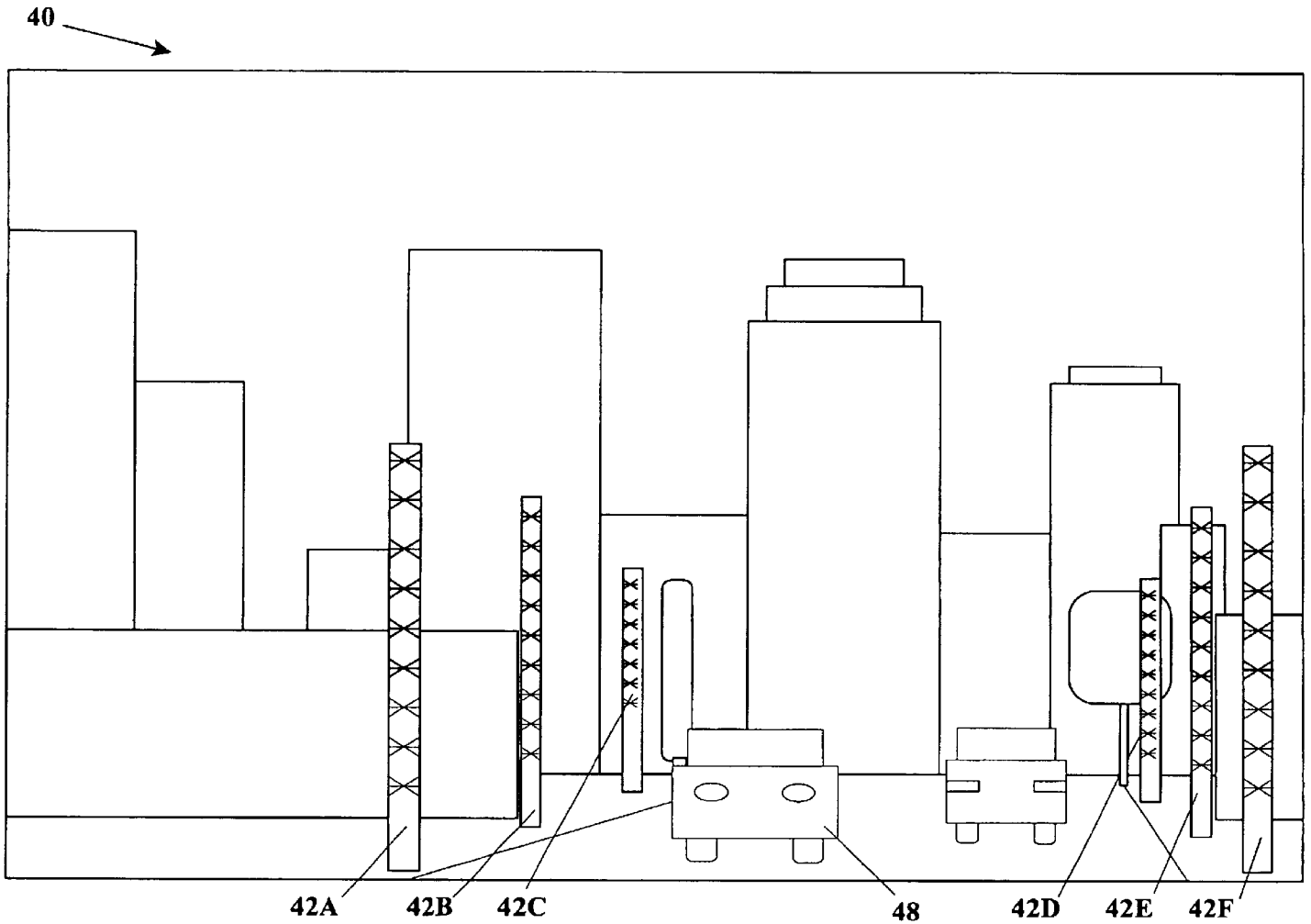
FIG. 7 depicts the vertically-oriented objects detected in the view of FIG. 3 as illuminated with the indicia of FIG. 6, according to the present invention.

Referring to FIG. 7, indicia 60A is shown as illuminated on objects 42A–F. As indicated above, indicia 60A would indicate to a motorist in vehicle 48 that emergency vehicle 12 is approaching from behind. In general, indicia 60A–C will appear on objects 42A–F in the color red, and become smaller and more intense as emergency vehicle 12 approaches. However, it should be understood that other alternatives are possible. For example, light source(s) 28A–B within warning unit 14 could be capable of emitting light beams of varying colors. As such, a color scheme could be developed that is indicative of the distance between emergency vehicle 12 and an illuminated object (e.g., object 42A). For example, indicia 60A could appear in the color yellow on object 42A when emergency vehicle 12 is greater than 100 yards away. Then, once emergency vehicle 12 comes within 100 yards of object 42A, indicia 60A could be turned to the color red.

The foregoing description of the preferred embodiments of this invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of this invention as defined by the accompanying claims.

I claim:

1. A method for providing an emergency vehicle approach warning, comprising:

scanning, from the emergency vehicle, an area in front of the emergency vehicle using a first light beam;

detecting, at the emergency vehicle, at least one object in the scanned area having a height to width ratio exceeding a predetermined threshold; and illuminating, from the emergency vehicle, the at least one object with a predetermined indicia using a second light beam, wherein the predetermined indicia indicates a direction of origin of the emergency vehicle.

2. The method of claim 1, wherein the scanning, detecting illuminating steps are continuously repeated at a frequency of at least approximately 12 Hz.

3. The method of claim 1, wherein the at least one object comprises at least one pole.

4. The method of claim 1, wherein an appearance of the predetermined indicia changes as the emergency vehicle approaches the set of objects.

5. The method of claim 1, wherein the first light beam has an intensity that is lower than the intensity of the second light beam.

6. The method of claim 1, wherein the first light beam and the second light beam are laser beams.

7. The method of claim 1, wherein the first light bean and the second light beam are emitted using electromagnetic deflections from a light source.

8. The method of claim 1, wherein the detecting step comprises:

receiving a return beam; and processing the return beam to detect at least one object having a height to width ratio exceeding a predetermined threshold.

9. A method for providing an emergency vehicle approach warning, comprising:

scanning, from an emergency vehicle, an area in front of the emergency vehicle using a first light beam having a first intensity;

detecting, at the emergency vehicle, at least one object in the scanned area having a height to width ratio exceeding a predetermined threshold; and illuminating, from the emergency vehicle, the at least one object with a predetermined indicia using a second light beam having a second intensity, wherein the predetermined indicia indicates a direction of origin of the emergency vehicle, and wherein an appearance of the predetermined indicia changes as the emergency vehicle approaches the at least one object.

10. The method of claim 9, wherein the scanning, detecting and illuminating steps are continuously repeated at a frequency of at least approximately 12 Hz.

11. The method of claim 9, wherein the first intensity is lower than the second intensity.

12. The method of claim 9, wherein the first light beam and the second light beam are laser beams.

13. The method of claim 9, wherein the first light beam and the second light beam are emitted using electromagnetic deflections from a light source.

14. The method of claim 13, wherein the light source is mounted on the emergency vehicle.

15. The method of claim 9, wherein the detecting step comprises:

receiving a return beam in response to the first light beam; and processing the return beam to detect at least one object in the scanned area having a height to width ratio exceeding a predetermined threshold.

16. An emergency vehicle approach warning system, comprising a light emitter for emitting a first light beam for scanning an area in front of an emergency vehicle to detect at least one object having a height to width ratio exceeding a predetermined threshold, wherein the light emitter further emits a second light beam to illuminate the at least one object with a predetermined indicia, wherein the predetermined indicia indicates a direction of origin of the emergency vehicle.

17. The system of claim 16, wherein the light emitter is contained within a warning unit that is mounted on the emergency vehicle.

18. The system of claim 16, wherein the predetermined indicia changes in appearance as the emergency vehicle approaches the set of objects.

19. The system of claim 16, further comprising image processing logic for processing a return beam received in response to the first light beam to detect the at least one object.

20. The system of claim 16, wherein the first light beam has an intensity that is lower than the intensity of the second light beam.

21. The system of claim 16, wherein the light source continuously alternates emission of the first light beam and the second light beam at a frequency of at least approximately 12 Hz.

22. The system of claim 16, wherein the first light beam and the second light beam are emitted from the light source using electromagnetic deflection.

23. The system of claim 16, wherein the first light beam and the second light beam are laser beams.

24. An emergency vehicle approach warning system, comprising a light emitter for emitting a first light beam for scanning an area to detect at least one object having a height to width ratio exceeding a predetermined threshold, wherein the light emitter further emits a second light beam to illuminate the at least one object with a predetermined indicia, and wherein the predetermined indicia changes in appearance as the emergency vehicle approaches the set of objects.

25. The system of claim 24, wherein the light emitter is contained within a warning unit that is mounted on the emergency vehicle.

26. The system of claim 24, further comprising image processing logic for processing a return beam received in response to the first light beam to detect the at least one object.

27. The system of claim 24, wherein the first light beam has an intensity that is lower than the intensity of the second light beam.

28. The system of claim 24, wherein the light source continuously alternates emission of the first light beam and the second light beam at a frequency of at least approximately 12 Hz.

29. The system of claim 24, wherein the first light beam and the second light beam are emitted from the light source using electromagnetic deflection.

30. The system of claim 24, first light beam and the second light beam are laser beams.

* * * * *